US006352386B2

(12) United States Patent
Heims

(10) Patent No.: US 6,352,386 B2
(45) Date of Patent: Mar. 5, 2002

(54) ROAD FINISHER HAVING A LAYING BEAM WITH AUTOMATICALLY ADJUSTABLE EXTENDABLE BEAMS

(75) Inventor: Dirk Heims, Bad Münder (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 0 days.

(21) Appl. No.: 09/031,021

(22) Filed: Feb. 26, 1998

(30) Foreign Application Priority Data

Mar. 6, 1997 (DE) ..... 197 09 131

(51) Int. Cl.[7] ..... E01C 23/07; E01C 19/22

(52) U.S. Cl. ..... 404/84.5; 404/112

(58) Field of Search ..... 404/84.5, 102, 404/108, 110, 112, 118, 72, 101

(56) References Cited

U.S. PATENT DOCUMENTS 556,266 A * 9/1896 Hohmann, Jr. ..... 404/84.5
3,638,540 A * 2/1972 Williams ..... 404/84.5
4,379,653 A * 4/1983 Brown ..... 404/118
4,493,585 A * 1/1985 Axer ..... 404/118
4,702,642 A 10/1987 Musil
4,759,657 A * 7/1988 Dorr et al. ..... 404/72
4,802,787 A * 2/1989 Bays ..... 404/84.5
4,818,140 A 4/1989 Carlson
4,823,366 A * 4/1989 Williams ..... 404/84.5
5,258,961 A * 11/1993 Sehr et al. ..... 404/84.5
5,288,167 A * 2/1994 Gaffard et al. ..... 404/84.5
5,393,167 A * 2/1995 Fujita et al. ..... 404/118
5,556,227 A * 9/1996 Ulrich ..... 404/101
5,735,634 A * 4/1998 Ulrich et al. ..... 404/102

* cited by examiner

*Primary Examiner*—Thomas B. Will
*Assistant Examiner*—Raymond Addie
(74) *Attorney, Agent, or Firm*—Michael Best & Friedrich LLP

(57) ABSTRACT

A road finisher has a chassis and a floating laying beam, which is located behind the chassis. The beam includes a centrally divided basic beam, and extendable beams which can extend laterally from the basic beam and can be height-adjusted, with respect to the basic beam. The basic beam and the extendable beams are arranged offset one behind the other in the direction of travel. The height adjusting devices are adjusted automatically in such a way that they keep the respective rear edges of the basic beam and of the extendable beams in the same plane. A control signal for the height adjusting devices is derived from measured values for the setting angle of the basic beam. The control signal is picked up by a sensors on the front of the tie bars for measuring the distance from a reference plane independent of the road finisher, and utilized to determine the height of the rear edge of the basic beam and of the extendable extendable beams.

5 Claims, 1 Drawing Sheet

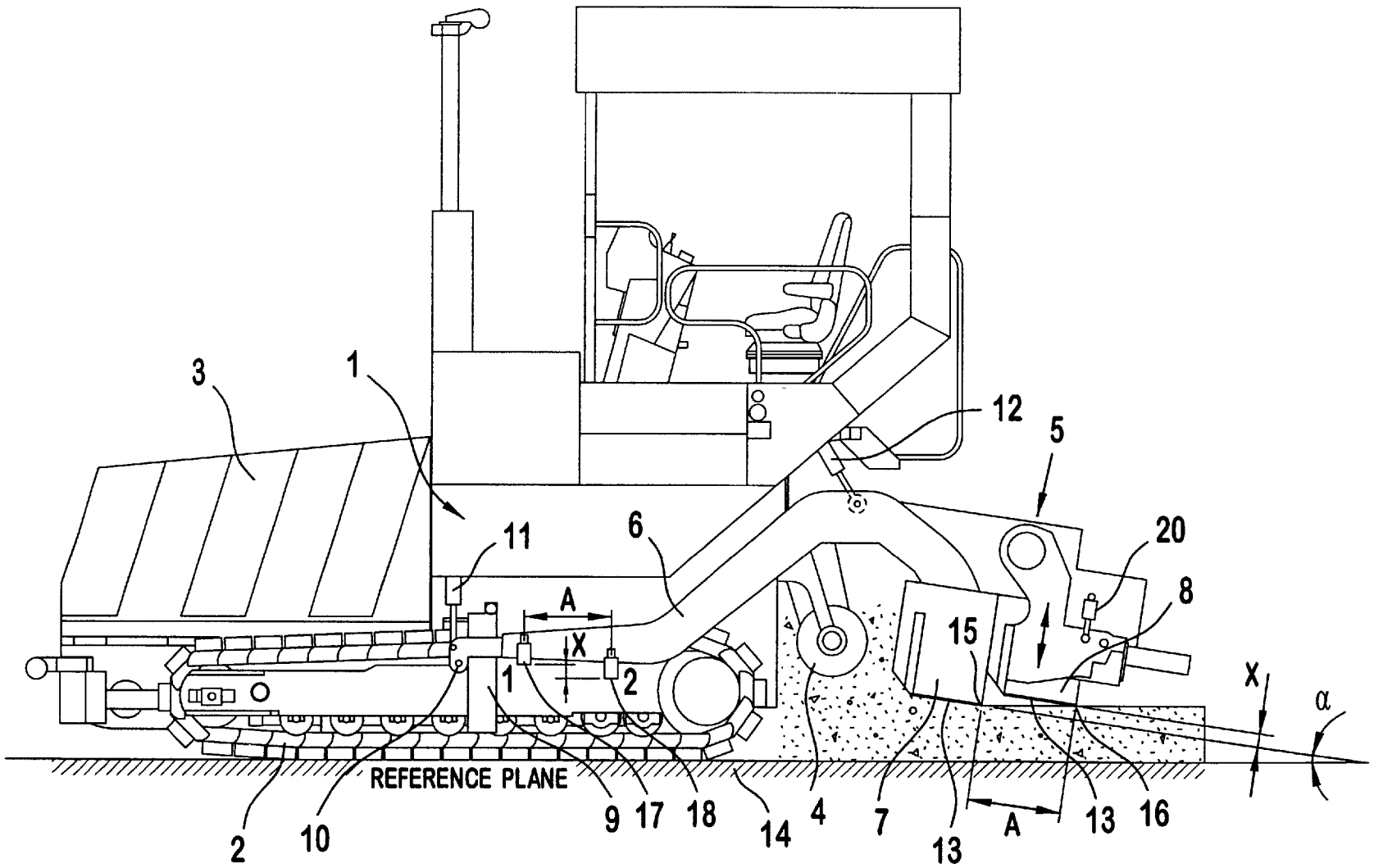
α
X
20
8
16
13
5
A
12
15
13
7
4
14
18
6
2
17
9
A
X
1
11
REFERENCE PLANE
1
10
2
3

ROAD FINISHER HAVING A LAYING BEAM WITH AUTOMATICALLY ADJUSTABLE EXTENDABLE BEAMS

BACKGROUND OF THE INVENTION

The invention relates to a road finisher for laying carriageway surfacings by means of a floating laying beam which comprises a basic beam and extendable beams.

Road finishers for laying mixed material, varying according to the thickness to be laid, in particular in the form of asphalt mixes, are nowadays generally provided with floating laying beams, which comprise a centrally divided basic beam, to allow a roof profile to be set, and can be widened by extendable beams. The basic beam is articulated by means of tie bars on the chassis and its height above the underlying carriageway determines the laying height of the mixed material to be laid. The extendable beams are usually arranged behind the basic beam, offset in the direction of travel with respect to the basic beam, articulated on the tie bars, by the depth of said basic beam. For laying level surfacings, the rear edges of the bearing surfaces of the basic beam and of the extendable beams must be in the same plane (inclined with respect to the horizontal when laying a roof profile).

In the case of a floating laying beam, the bearing surface of the laying beam, resting on the material laid, has a positive setting angle in the direction of laying or direction of travel, to allow it to float on the material laid. This setting angle is dependent on various parameters, such as the load-bearing capacity of the mixed material to be laid, the weight of the laying beam, the degree of compaction achieved by the laying beam, the thickness of the course of the mixed material to be laid and the traveling speed.

Changes in the setting angle require a correction in the vertical position of the extendable beams in relation to the basic beam, to continue to ensure the levelness in the transverse profile. These changes in the setting angle may be performed manually by means of two spindles actuated by ratchets for each extendable beam.

These corrective measures are very laborious, especially since they may have to be performed on both extendable beams and often require recorrections, since the first adjusting step often only represents an approximation to the setting ultimately required.

DE 92 11 854 U1 discloses a road finisher in which, to avoid longitudinal steps in the surface contour of the material laid, a sensor is provided in the form of a pendulum on the basic beam, for the inclination of the latter. The sensor signal is used to adjust the extendable beams correspondingly by means of actuating drives. However, in this case, the inclination of the basic beam at the point of the sensor is measured with respect to the horizontal and not with respect to the actual laying plane, which may be inclined both in the direction of laying and transversely thereto with respect to the horizontal. This has the result that, on the one hand, the beam distortions occurring when traveling around bends during the laying of superelevations cannot be taken into account and that, on the other hand, changes in the load-bearing capacity of the material laid which may lead to changed floating of the laying beam, for example slumping of the laying beam, as well as elevations or depressions in the laying plane may lead to undesired step formation in the direction of laying. The occurrence of such changes would have to trigger in particular an immediate reaction, which permits no account to be taken of the laying rate and, in particular, of changes in the laying rate as well as the load-bearing capacity of the material laid, with the result that sufficiently accurate and uniform laying is not made possible.

The foregoing illustrates limitations known to exist in present road finishers. Thus, it is apparent that it would be advantageous to provide an alternative directed to overcoming one or more of the limitations set forth above. Accordingly, a suitable alternative is provided including features more fully

SUMMARY OF THE INVENTION

In one aspect of the present invention, this is accomplished by providing a road finisher comprising: a chassis; a floating laying beam located behind the chassis; the laying beam comprising: a centrally divided basic beam; means for articulating the basic beam on both sides of the chassis by means of two tie bars; a pair of extendable beams, which can extend laterally from the basic beam; the basic beam and the extendable beams being arranged offset, one behind the other, in the direction of travel; and height-adjusting means for adjusting the height of the extendable beams vertically up and down, with respect to the basic beam.

The invention is explained in more detail below with reference to an exemplary embodiment represented in the accompanying illustration, diagrammatically showing a road finisher in side view.

BRIEF DESCRIPTION OF THE DRAWING FIGURES

FIG. 1 diagrammatically shows a road finisher of the invention in side view.

DETAILED DESCRIPTION

The road finisher represented comprises a chassis 1 with crawlers 2, the chassis 1 having at the front a container 3 and at the rear a spreading screw 4, between which there is arranged a Conveyor (which cannot be seen in the representation) for transporting mixed material to be laid from the container 3 through a conveying shaft, over which there are superstructures, into the region of the spreading screw 4.

Articulated by means of tie bars 6 on the chassis 1 is a laying beam 5 for the floating laying of the mixed material to be laid. The laying beam 5 is located behind the region of the spreading screw 4, in the direction of laying, and comprises a basic beam 7 as well as extendable beams 8, which can be extended laterally with respect to said basic beam and independently of one another. The basic beam 7 is usually centrally divided, the two halves of the basic beam 7 being able to be inclined with respect to each other for setting a roof profile transversely with respect to the direction of laying. By means of the extendable beams 8, the basic beam 7 can be widened to approximately twice its width. If further widening is desired, this is performed by beam parts which can be manually attached to the extendable beams 8. The extendable beams 8 are generally offset by the beam depth A with respect to one another, seen in the laying direction.

The laying beam 5 expediently comprises a combination of tamping and smoothing tools, which form a course by compacting and smoothing the mixed material which is to be laid and is spread out by the spreading screw 4 in front of the latter.

Each tie bar 6 is pivotally articulated at its front end on the chassis 1, the point of articulation being adjustable in height with respect to the chassis 1. This is accomplished, for example, by the tie bar 6 being forked at its front end, engaging around a flat plate 9 with its forked end and supporting itself on the flat plate 9 via a bearing ring of a bearing arranged at 10 in the forked end and absorbing tensile forces, while an actuating cylinder 11 acts on the forked end and determines the height of the point of articulation with respect to the chassis 1.

A further actuating cylinder 12 serves for raising the laying beam 5 into the transporting position. In the case of laying, the actuating cylinder 12 is in the floating position, i.e. the laying beam 5 is prevented from floating during transport. The setting angle alpha must be positive in the direction of laying, i.e. the bearing surfaces 13 must be higher at the front than at the rear (seen in the direction of laying).

To obtain a level laid surfacing in transverse profile (without or with roof profile or inclination), the rear edge 15 of the basic beam 7 and the rear edges 16 of the extendable beams 8 must be in the same vertical position with respect to one another, even irrespective of whether laying with a roof profile or transverse inclination. Accordingly, the extendable beams 8 are adjusted in their height with respect to the basic beam 7 by an amount X.

Changes in the setting angle alpha must be compensated by a corresponding change in the amount X, to retain a level laid surfacing.

For this purpose, in the case of the exemplary embodiment represented there are two sensors 17, 18 arranged on each tie bar 6, in the front region thereof, which measure the distance from the reference plane, the underlying carriageway 14. The sensors 17, 18 are arranged offset with respect to each other in the direction of laying by the distance of the offset between the basic beam 7 and the extendable beams 8, namely the beam depth A. In addition, the sensors 17, 18 are arranged at such a height above the reference plane, the underlying carriageway 14, that they measure the same vertical distance from the reference plane, the underlying carriageway 14, when the bearing surfaces 13 of the basic beam 7 and of the extendable beams 8 run parallel with respect to the reference plane. In this case, with any desired setting angle alpha, the difference in height of sensor 17 with respect to sensor 18 corresponds in each case to the amount X. The output signals of the respective sensors 17, 18 produce the value X, and this is used to derive a control signal which is used as the manipulated variable for the height correction of the respective extendable beam 8.

With a different choice of the arrangement of the sensors 17,18, corresponding proportionality factors have to be taken into account when generating a control signal derived from their measured values.

The adjustment of the extendable beams 8 with respect to the basic beam 7 controlled in this way may take place by means of electrically or electromechanically actuable height-adjusting devices 20, for example in the form of hydraulic motors, hydromechanical, electromechanical drives or hydraulic cylinders with check valves.

There may, however, also be provided more than two sensors 17, 18, for example four or five sensors, arranged one behind the other for each tie bar 6, signals from sensors with untypical measured values being filtered out in order to eliminate errors.

Furthermore, it is expedient to average the signals of the sensors 17, 18 over time, in order to "smooth" small unevenness in the underlying carriageway 14 representing the reference plane and consequently not to perform unnecessarily frequent adjustments to the extendable beams 8.

The sensors 17, 18 are preferably ultrasonic sensors, although other contactlessly operating sensors can also be used. A paved gutter, a previously laid course or a reference wire, as is used for height leveling, may also be used as the reference plane.

Thus, it can be understood that the the automatic height adjustment of the extendable beams is performed by measuring the distance from a reference plane, independent of the road finisher, sufficiently, in advance to achieve smooth transitions, with the result that the quality of the laying of surfacings is improved.

What is claimed is:

1. A road finisher for paving a road surface over a reference plane, the road finisher comprising:

a chassis;

a tie bar having a front portion that is pivotally connected to the chassis at a vertically adjustable point of articulation;

a floating laying beam connected to the tie bar at a rear end of the finisher, the floating laying beam including a basic beam having a planar bearing surface and a rear edge that is located above the reference plane, and an extendable beam adjacent to the basic beam, the extendable beam having a planar bearing surface and a rear edge that is located above the reference plane and offset, in a direction of laying, from the basic beam rear edge, the extendable beam being movable relative to the basic beam;

a sensor arrangement including a pair of sensors, spaced apart in the direction of laying, mounted to the front portion of the tie bar, each sensor configured to measure a respective distance from the sensor to the reference plane, the sensor arrangement calculates a difference between the two measured distances to derive a control signal which represents a distance the extendable beam bearing surface is to be spaced relative to the basic beam bearing surface such that the rear edges of the basic beam and the extendable beam are equally spaced relative to the reference plane; and a height adjusting device that automatically moves the extendable beam relative to the basic beam based upon the control signal such that the rear edge of the extendable beam and the rear edge of the basic beam are maintained at equal distances above the reference plane.

2. The road finisher of claim 1, wherein the sensors are arranged at equal distances from the reference plane when the bearing surfaces of the basic beam and the extendable beam are substantially parallel with the reference plane.

3. The road finisher of claim 2, wherein the difference between the measured distances of the two sensors relative to the reference plane equals the difference between the planes defined by the bearing surface of the basic beam and the bearing surface of the extendable beam.

4. The road finisher of claim 1, wherein the distances measured by each sensor are averaged over time.

5. The road finisher of claim 1, wherein the rear edges of the basic and extendable beam are offset by a given distance and the two sensors are spaced from one another by the given distance.

* * * * *